313-414
7/28/81 XR 4,281,270 SR

United States Patent [19]
Abeles
[11] 4,281,270
[45] Jul. 28, 1981

[54] PRECOATED RESISTIVE LENS STRUCTURE FOR ELECTRON GUN AND METHOD OF FABRICATION

[75] Inventor: Benjamin Abeles, Princeton, N.J.
[73] Assignee: RCA Corporation, New York, N.Y.

[21] Appl. No.: 51,400
[22] Filed: Jun. 25, 1979
[51] Int. Cl.[3] ..... H01J 29/82
[52] U.S. Cl. ..... 313/444; 313/414; 313/450; 29/25.13
[58] Field of Search ..... 313/411, 412, 413, 414, 313/444, 448, 449, 450, 477, 479; 29/25.13

[56] References Cited

U.S. PATENT DOCUMENTS 2,143,390 1/1939 Schroter .
2,313,018 3/1943 Krause .
3,932,786 1/1976 Campbell .
4,010,312 3/1977 Pinch et al. .
4,091,144 5/1978 Dresner et al. .

*Primary Examiner*—Palmer C. Demeo
*Assistant Examiner*—D. R. Hostetter
*Attorney, Agent, or Firm*—Eugene M. Whitacre; Glenn H. Bruestle; Vincent J. Coughlin, Jr.

[57] ABSTRACT

An electron gun includes two electrodes between which a resistive lens structure is mounted. The lens structure comprises a stack of alternate apertured electrode plates and insulator spacer blocks. A high resistance coating of, e.g., cermet or glaze material, is precoated along one side of each spacer block prior to assembly of the stack, so that upon assembly the stack has a high resistance electrical continuity from one end to the other.

11 Claims, 4 Drawing Figures

PRECOATED RESISTIVE LENS STRUCTURE FOR ELECTRON GUN AND METHOD OF FABRICATION

BACKGROUND OF THE INVENTION

This invention relates to electron guns, and especially to electron guns for use in television picture tubes. The invention is particularly directed to electron lenses for such guns, and more particularly to long focal length lenses (extended lenses) of the resistive type.

It is well known that spherical aberration in an electron lens can be desirably reduced by increasing the focal length of the lens, i.e. by making the field of the lens weaker and extending it over a greater length along the path of the beam. It is also well known that the focal length of a lens can be lengthened by increasing the size of the lens aperture and/or the gap between two electrodes of the lens. However, increasing the diameter of the lens conflicts with the desire to dispose the electron gun in a small neck of a cathode ray tube in order to minimize required deflection power; and increasing the gap between the electrodes may allow other electric fields external to the lens to penetrate the gap and distort the focus field.

The prior art has disclosed various extended lens structures designed to achieve longer focal length without the attendant disadvantages described above. One such type of extended lens is the resistive lens exemplified by FIG. 1 of U.S. Pat. No. 2,143,390 issued to F. Schroter on Jan. 10, 1939; by U.S. Pat. No. 3,932,786 issued to F. J. Campbell on Jan. 13, 1976; and by FIG. 3 of U.S. Pat. No. 4,091,144 issued to J. Dresner et al on May 23, 1978. In this type of lens, a plurality of metal electrode plates are arranged in serial fashion and a voltage gradient is established along the lens by applying different voltages to the different plates by way of a resistive bleeder element provided within the vacuum envelope of the electron tube itself. Although Schroter shows this resistor only schematically, Campbell discloses a practical embodiment of a bleeder resistor disposed on an insulator element of the electron gun structure, and Dresner et al show a practical embodiment of a stack of alternate metal electrodes and insulator blocks with a resistive bleeder coating applied along one edge of the stack. However, in practice, the Campbell structure has proved to have attendant problems of stray emission because of the many connectors required to make contact between the series of apertured electrodes and the bleeder resistor, and both the Campbell and Dresner et al lenses depend for their field accuracy upon the uniformity of the resistive bleeder coating, the fabrication of which is very difficult to control. Furthermore, neither the Campbell nor the Dresner et al lenses provide the flexibility desired for accurately shaping the lenses' voltage profile along the beam path.

SUMMARY OF THE INVENTION

A resistive type extended electron lens comprises a plurality of apertured electrodes and a plurality of resistive spacer blocks. The electrodes and the blocks are alternately stacked and secured together to form an electrically continuous structure. The resistive blocks comprise insulator blocks which, prior to being assembled into a unitary stack with the apertured electrode plates, are each coated along at least a portion of one surface with a suitable resistive material. Such precoating (i.e. coating prior to assembly) of the blocks allows them to be pretested before assembly and sorted according to their resistivity characteristics. The resistive material is preferably a cermet as disclosed in U.S. Pat. No. 4,010,312 issued to Pinch et al on Mar. 1, 1977.

DETAILED DESCRIPTION OF THE PREFERRED EMBODIMENT

The present invention is shown as embodied in a 3-beam in-line electron gun of the type described in U.S. Pat. No. 3,772,554 issued to R. H. Hughes on Nov. 12, 1973. The Hughes patent is incorporated by reference herein for the purpose of disclosure. The invention may however be used in other types of electron guns.

Figure 1:
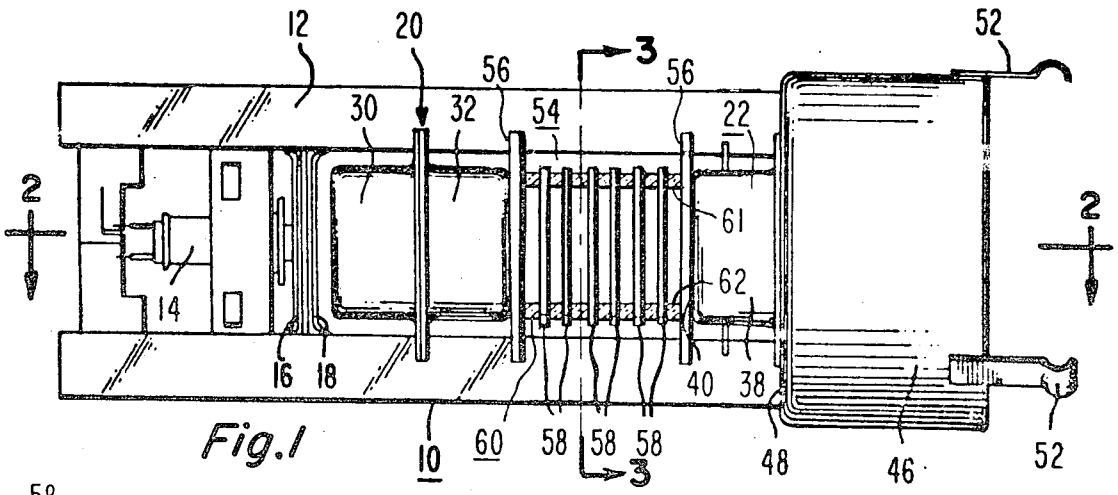
FIG. 1 is an elevation view of the novel electron gun with parts broken away and shown in section.
Figure 2:
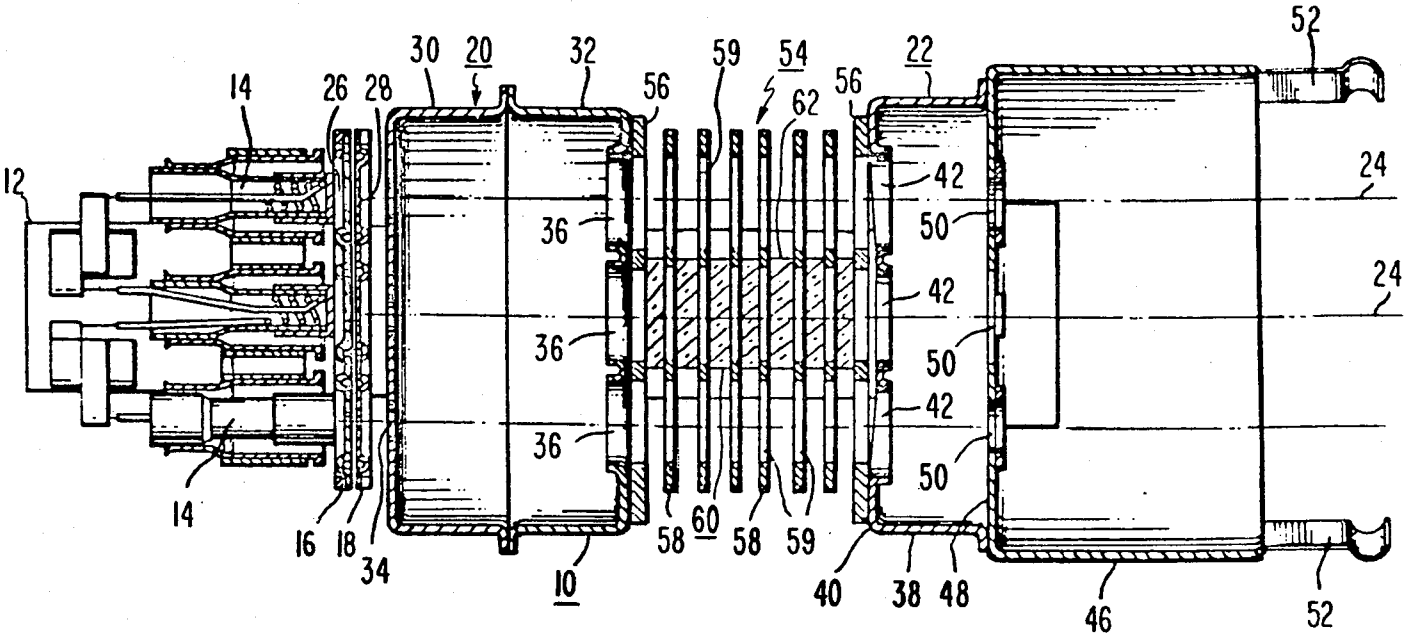
FIG. 2 is a longitudinal section view of the novel electron gun taken along line 2—2 of FIG. 1.

As shown in FIGS. 1 and 2, an electron gun 10 comprises two parallel glass support rods 12 on which various electron gun elements are mounted. At one end of the support rods 12 are mounted three cup-shaped cathodes 14 having emissive surfaces on their end walls. Mounted in spaced relation beyond the cathodes 14 are a control grid electrode 16, a screen grid electrode 18, a first accelerating and focusing electrode 20 and a second accelerating and focusing electrode 22. The three cathodes 14 project electron beams along three coplanar beam paths 24 through apertures in the electrodes.

The control grid electrode 16 and the screen grid electrode 18 comprise substantially flat metal members each containing three in-line apertures 26 and 28 respectively which are aligned with the beam paths 24.

The first accelerating and focusing electrode 20 comprises two somewhat rectangularly shaped cups 30 and 32 joined at their open ends. The closed ends of the cups 30 and 32 each have three in-line apertures 34 and 36 respectively such that each aperture is aligned with a separate beam path 24.

The second accelerating and focusing electrode 22 comprises a somewhat rectangular cup 38 having a base 40. The base 40 faces toward the first accelerating and focusing electrode 20 and has three in-line apertures 42 therein. The center aperture 42 is aligned with the center aperture 36 of the first accelerating and focusing electrode 20. The two outer apertures 42 are slightly offset outwardly with respect to the corresponding outer apertures 36 of the first accelerating and focusing electrode 20.

A shield cup 46 having a base 48 is attached to the second accelerating and focusing electrode 22 so that the base covers the open end of the second accelerating and focusing electrode. The shield cup 46 has three in-line apertures 50 through its base 48, each aligned with one of the beam paths 24. The shield cup also has a plurality of bulb spacers 52 attached to and extending from its open end.

In operation, the electron gun 10 is designed to have its main focus field established between the first and second accelerating and focusing electrodes 20 and 22. To this end a novel resistive lens structure 54 is disposed between these electrodes.

Figure 3:
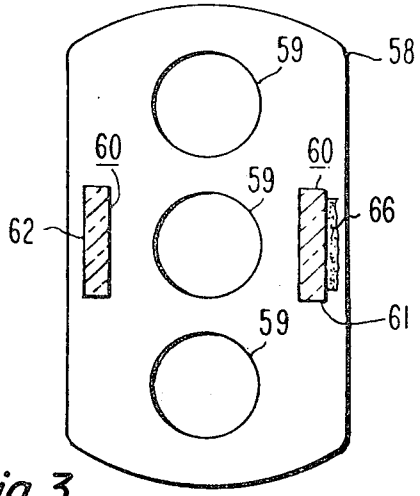
FIG. 3 is a section view taken along line 3—3 of FIG. 1.

The resistive lens structure 54 comprises a pair of end electrode plates 56 and a plurality, e.g., six, intermediate electrode plates 58. As shown in FIG. 3, each intermediate plate 58 is provided with three in-line apertures 59, each of which is aligned with one of the beam paths 24. The end plates 56 have corresponding aligned apertures. The eight plates 56, 58 are alternately stacked with rectangular parallelepiped spacer blocks 60. A pair of the spacer blocks 60 are disposed between any two adjacent plates 56, 58. Each pair of spacer blocks 60 are disposed on opposite sides of the central one of the apertures 59 and adjacent to an outer edge of an intermediate plate 58. At least one block of each pair of spacer blocks 60 comprises a resistive block 61 as hereinafter described. The other block of the pair of spacer blocks 60 may comprise either a resistive block 61 or an insulator block 62. When only one resistive block 61 is desired between a pair of electrode plates 56, 58, an insulator spacer block 62 is included for mechanical support purposes.

The insulator blocks 62 may be made of any insulating material suitable for assembly with the electrode plates and compatible with conventional electron tube thermal and vacuum processing. Conventional ceramics, such as high grade alumina, are preferred.

The resistive blocks 61 preferably comprise insulator blocks 62 having the pair of opposite surfaces which are in contact with two of the electrode plates 56, 58 coated with electrically separate metallic conductive films, and a surface connecting the two film-coated surfaces coated with a layer of a suitable high resistive material, which overlaps portions of the surfaces of the two metallic films so as to make good electrical contact therewith.

Figure 4:
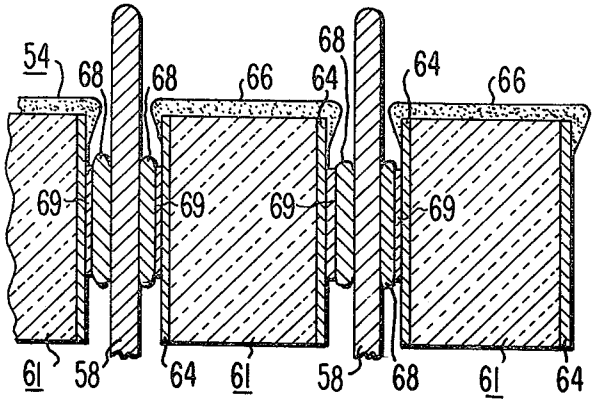

FIG. 4 illustrates the details of the preferred form of assembly of electrode plates 56 and resistive blocks 61. Each of the resistive blocks 61 is provided with two electrically separate metallized films 64 on the two opposite surfaces thereof which contact a pair of the electrode plates 56, 58. After the resistive blocks have been provided with their metallized films 64, and prior to assembling the blocks into the stacked lens 54, they are coated with a layer 66 of suitable high resistance material on the surface which connects the two mutually opposite film-coated surfaces. In the preferred embodiment, as illustrated in FIG. 4, the resistive layer 66 wraps around two of the corners of the block 61 to make good overlapping contact with portions of the surfaces of the metallized films 64. The resistive blocks 61 are then assembled with the electrode plates 56, 58 and secured thereto preferably with a suitable brazed joint 68. In order to promote wetting of the metallized film 64 with the brazing material, a portion of the film 64 is first covered with a strike 69 of nickel. The nickel strike 69 is confined to the central portion of the metallized film 64 and thus confines the flow of the brazing material.

With the resistive lens stack 54 thus secured into a unitary assembly, electrical continuity is provided from one end of the stack to the other, with each resistive block 61 providing a significant resistance between any two adjacent electrode plates 56, 58. Thus, a bleeder resistor is provided such that when an appropriate voltage is applied to the first and second accelerating and focusing electrodes 30 and 22, a bleeder current flows through the high resistance coatings 66 causing a voltage drop along the lens stack so as to establish a different potential on each of the electrode plates 56 and 58. Such different voltages provide a voltage gradient which in turn produces the desired extended lens between the first and second accelerating and focusing electrodes 20 and 22.

Figure 5:
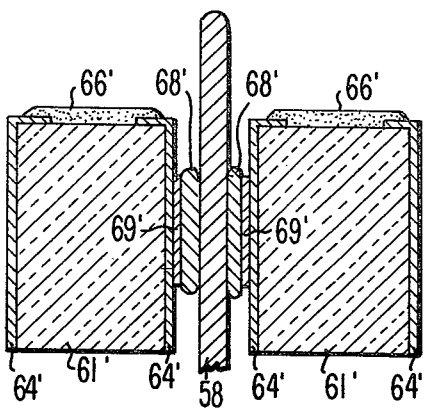
FIGS. 4 and 5 are enlarged sections of alternative embodiments of the lens structure of the novel gun.

FIG. 5 illustrates a modification of the resistive blocks 61 wherein resistive blocks 61' are provided on two of their opposite faces with electrically separate metallized coatings 64' which extend slightly around the corner of the blocks onto a face connecting the two metallized coated surfaces. A high resistance layer 66' is then provided on the connecting surface such that it overlaps the ends of the surfaces of the metallized coatings 64' thereon. As such, it is unnecessary to extend the resistive coating around the corners of the block and onto the mutually opposite metallized surfaces as shown in FIG. 4.

U.S. Pat. No. 4,091,144 issued to Dresner et al discloses a resistive lens structure which is similar to the present novel structure in that they both comprise a stack of alternate electrode plates and resistive spacer blocks. However, these lens structures differ significantly in the structural details of their resistive material and the procedures with which they are fabricated. In the Dresner et al structure the electrodes and insulator blocks are first assembled and then the resistive material is coated along one edge of the assembled stack. Unlike this, the present novel lens structure 54 is provided by precoating insulator blocks with the desired resistive material to form the resistive blocks 61 prior to their assembly into a stack with the electrode plates 56, 58. Such precoating allows the resistive coated blocks to be tested and selected for appropriate resistivities. Thus, nonuniformities in resistance due to uncontrollable variations in the resistive material coating process can be accommodated by preselecting blocks of desired resistivity and fabricating the stacked lens 54 with blocks of known, and therefore desirable, resistance values. Such procedure not only permits selection of blocks having equal resistances in order to provide a linear voltage gradient along the stacked lens 54, but, if desired, permits selection of a gradation of resistances from block to block so that some desired nonlinear voltage gradient can be provided. The precoating of the resistive blocks 61 thus allows a degree of flexibility that is not possible with the Dresner et al structure.

In accordance with one specific example, fabrication of the resistive blocks 61 is performed by first lapping a good quality $Al_2O_3$ plate, e.g. (Alsimag #771 or #772) from slightly thicker stock to dimensions 2 inches$\times$2 inches$\times$0.040 inch (50.8$\times$50.8$\times$1.016 mm). The large opposite faces of the plate are then provided with the metal films 64 by sputtering first a thin layer of titanium and then a layer of tungsten, onto the $Al_2O_3$ plate.

The plate is then cut into 60 mil (1.524 mm) wide strips ("logs") with a diamond saw. The logs are inserted in a holder which leaves exposed one of the bare $Al_2O_3$ faces, and about one third of the Ti/W covered faces. A W-$Al_2O_3$ cermet is then sputtered onto the thus exposed areas of the log to provide a precoated resistive block 61 as shown in FIG. 4. The overlap of the resistive layer 66 onto the metal film 64 provides good electrical contact.

The logs are then annealed to bring the through resistance to convenient values (about $10^8$ to $10^{10}$ $\Omega$ for the finished blocks). Although selective annealing will provide selective resistivity, it is not feasible to monitor resistivity while the blocks are in the annealing furnace because at temperatures above 400° C. the conductivity of the ceramic is appreciable. Nevertheless, with a few measurements obtained by removing selected logs from the furnace, it is possible to closely reproduce any desired distribution of resistances for a given annealing run.

Following annealing, the logs are then inserted in another jig, and returned to a sputtering system for deposition of the braze material. This comprises a Ni flash to promote wetting of the W surface, followed by a thick layer of Cu-Ag eutetic solder. One side is sputter coated at a time. The logs are then flipped over to coat the opposite face. The logs are then diced into 200 mil (5.08 mm) long blocks 61.

The following Table summarizes typical sputter schedules and layer thicknesses in one preferred example of resistive block fabrication.

| Material | Time (minutes) | Thickness (microns) |
|---|---|---|
| Ti | 17 | 0.1 |
| W | 35 | 0.2 |
| W—$Al_2O_3$ | 240 | 0.7 |
| Ni | 20 | 0.5 |
| Solder | 120 | 3.0 |

Various dimensional relationships, resistance values and materials can be used in fabricating the resistive lens structure 54. Choice of these parameters will depend upon the particular electron gun structure and the equipment for which it is intended. It is usually desirable to operate the voltage bleeder provided by the high resistance coatings 66 with a bleeder current of from 5–10 microamps and with a power dissipation of 0.5 watt or less. Typical voltage gradients employed are usually in the range of $2.5–4.0\times10^4$ volts per centimeter.

Materials which have been found to be suitable for the electrode plates 56, 58 include molybdenum, copperclad stainless steel, or any other metal compatible with the fabrication techniques employed. Alumina ceramics are preferred for the spacer blocks.

Alumina spacer blocks 60 have been suitably metallized with molybdenum metallization applied by well known inking techniques or by sputtering on titanium-tungsten metallized coatings. The metallized blocks can be brazed to molybdenum electrodes with conventional silvercopper solder.

The shape of the spacer blocks 60 is not critical. Each pair of spacer blocks could, for example, comprise a single rectangular annulus, with a resistive coating being applied on one or more of the legs thereof. Simple rectangular blocks are preferred. Neither is the positioning of the blocks 60 on the electrode plates 56, 58 critical. However, in the embodiment of FIG. 4, the blocks are preferably spaced away from the apertures 59 a distance at least as great as the thickness of the blocks so as to avoid excessive interference with the lens fields in the apertures, and spaced back from the edge of the electrode plates a distance, e.g. 15 mils (0.381 mm), to minimize arcing between them and other parts of the electron tube.

Sputter-deposited cermet materials as described in U.S. Pat. No. 4,010,312 to Pinch et al are preferred for use as the high resistance coating 66. Adjustment of resistivity as taught in this patent can be practiced in order to obtain the desired overall resistance for the particular electron gun into which the resistive lens structure is incorporated. The thickness of such coatings can be significantly varied and a desired resistivity obtained by appropriate annealing as taught in the Pinch et al patent. Suitable coatings have been made from about 0.35 to about 0.7 micron thickness, but these values are considered only as a preferred range and not operable limits. To this end the Pinch et al patent is incorporated herein by reference for purpose of its disclosure.

Alternatively, resistive inks can be suitably used for the coatings 66 provided they possess the desired high resistance. Generally speaking, any resistive material which provides suitably high resistance values and is compatible with lens assembly and electron tube fabrication schedules can be used.

In one example of the novel resistive lens structure 54, the electrode plates 56, 58 were made of 10 mil (0.254 mm) thick molybdenum to which a strike of nickel was applied to promote brazability. Three in-line apertures 59 were provided having diameters of 160 mils (4.064 mm) spaced 200 mils (5.08 mm) apart. The spacer blocks 60 were of alumina and were 40 mils (1.016 mm) thick and 200 mils (5.08 mm) long and coated with titanium-tungsten metal films 64. Use of two end plates 56, six intermediate plates 58 and seven pair of spacer blocks 60 produced a lens structure 360 mils (9.144 mm) in length. The resistive coatings 66 for this lens structure were provided by sputter depositing a 0.7 micron thick cermet layer having a resistance from plate to plate of approximately $10^9$ ohms. The lens was operated with a focus potential of 3300 volts on the first accelerating and focus electrode 20 and an ultor potential of 25000 volts on the second accelerating and focus electrode 22.

What is claimed is:

1. An electron gun comprising a plurality of electrodes and a resistive lens structure disposed between two of said electrodes, said lens structure comprising:

(a) a plurality of apertured electrodes, and (b) a plurality of resistive spacer blocks, (c) said apertured electrodes and said blocks being alternately stacked together such that each resistive block provides an electrical resistive connection between the two apertured electrodes on either side thereof, (d) each of said resistive blocks comprising an insulator block having a separate precoated layer of resistive material on a surface thereof.

2. The electron gun of claim 1 wherein each of said resistive blocks includes electrically separate metal films on at least portions of at least a pair of opposite faces of said blocks in electrical contact with a pair of adjacent apertured electrodes, and said layer of resistive material extends between and overlaps at least a portion of the surfaces of said metal films.

3. The electron gun of claim 2 wherein said resistive material is a cermet.

4. The electron gun of claim 1 wherein said resistive blocks have metallized coatings on surface portions thereof which are brazed to said apertured electrodes on either side thereof whereby to bond said alternately stacked electrodes and resistive blocks into an integral subassembly.

5. The electron gun of claim 1 wherein said resistive blocks are selected to have substantially equal resistances prior to stack assembly, whereby to provide a lens having a linear axial voltage profile.

6. The electron gun of claim 1 wherein said resistive blocks are selected to have unequal resistances prior to stack assembly, whereby to provide a lens having a non-linear axial voltage profile.

7. The electron gun of claim 1 further including a plurality of insulator spacer blocks, each of said insulator spacer blocks being paired with a resistive spacer block with each pair disposed between two adjacent ones of said apertured electrodes.

8. An electron gun comprising a plurality of electrodes and a resistive lens structure disposed between two of said electrodes, said lens structure comprising:

(a) a plurality of apertured electrode plates, and (b) a plurality of rectangular parallelepiped resistive spacer blocks, (c) said apertured electrodes and said blocks being alternately stacked and secured together such that said stack is electrically continuous from one end to the other and includes a significant electrical resistance between each pair of adjacent apertured electrodes, (d) each of said resistive blocks having an electrically continuous precoated layer of resistive material thereon which covers portions of the two opposite faces of said block which contact the two apertured electrodes adjacent thereto.

9. The electron gun of claim 1 wherein said layer of resistive material on each block substantially covers one parallelepiped surface thereof and extends onto portions of said two opposite faces thereof.

10. The method of making an electron gun including a resistive lens structure comprising a stack of alternate apertured electrodes and resistive spacer blocks; said method comprising the steps of (1) applying a continuous coating of resistive material to portions of two opposite faces of each of a plurality of insulator blocks, and then (2) stacking the thus coated blocks alternately with a plurality of said apertured electrodes, and (3) securing the stacked blocks and electrodes together to provide an electrically continuous assembly from one end to the other with each block providing a significant electrical resistance between its two adjacent electrodes.

11. The method of claim 10 wherein said two opposite faces of said blocks are coated with metal films prior to application of the resistive material coating so that said resistive coating overlaps onto said metal films, and wherein said securing step comprises brazing the electrodes to said metal films.

* * * * *